US007210970B1

(12) United States Patent
Pellon et al.

(10) Patent No.: US 7,210,970 B1
(45) Date of Patent: May 1, 2007

(54) CIRCUIT BREAKER WITH IMPROVED CONNECTOR SOCKET

(75) Inventors: Christian V. Pellon, Norton, MA (US); Michael J. Lavado, Griswold, CT (US); Jacky C. Chan, Framingham, MA (US)

(73) Assignee: Sensata Technologies, Inc., Attleboro, MA (US)

( * ) Notice: Subject to any disclaimer, the term of this patent is extended or adjusted under 35 U.S.C. 154(b) by 0 days.

(21) Appl. No.: 11/386,370

(22) Filed: Mar. 22, 2006

(51) Int. Cl.
*H01R 4/36* (2006.01)

(52) U.S. Cl. ..... 439/810; 335/132; 335/83; 335/6; 335/202

(58) Field of Classification Search ..... 335/6, 335/132, 202, 83; 439/810
See application file for complete search history.

(56) References Cited

U.S. PATENT DOCUMENTS 3,361,882 A 1/1968 Clarke
5,874,876 A * 2/1999 Kobayashi et al. ..... 335/128
6,225,880 B1 * 5/2001 Kern ..... 335/78

* cited by examiner

*Primary Examiner*—Truc Nguyen
(74) *Attorney, Agent, or Firm*—Russell E. Baumann

(57) ABSTRACT

A shouldered connector pin socket (14) is shown having an open channel (14*a*) formed in the face surface of a wall member of a circuit breaker housing. An electrically conductive spring member (16, 16') is received over the channel and is formed with a first set of spring fingers (16*d*) that are adapted to engage a connector pin along a first axial length (14*c*) of the channel making electrical engagement with the pin and urging the pin against the channel surface as the pin is slidingly inserted into the channel. The spring fingers urge the flange of the connector pin into a recess formed by a stepped shoulder defining the entrance to a second axial length (14*d*) with the stepped shoulder and the spring fingers cooperating to retain the connector pin in the channel. A second set of spring contact fingers (16*e*) can also be used to engage the connector pin along a third axial length (14*e*) and thereby provide a redundant contact system.

18 Claims, 12 Drawing Sheets

CIRCUIT BREAKER WITH IMPROVED CONNECTOR SOCKET

FIELD OF THE INVENTION

This invention relates generally to electrical circuit breakers and particularly to miniature circuit breakers having arc fault features and various auxiliary circuit functions.

BACKGROUND OF THE INVENTION

Subminiature thermal circuit breakers are widely used in applications in which spatial limitations are of particular importance, such as in aircraft. Such devices employ, for example, a thermostatic current carrying member that upon a selected overload condition causes a latching mechanism to unlatch and open a circuit path connected to the breaker by the movement of at least one movable electrical contact from a mating stationary electrical contact.

In recent years there has been a trend to add other functions to such circuit breakers, for example, providing various auxiliary circuits including arc fault protection. Among the challenges that must be dealt with in providing such enhancements is a space limitation for such circuit breakers. For many applications the space available for an individual circuit breaker cannot be significantly increased, even though new functions are added, due to the existing layout of the control panel in which such circuit breakers are mounted.

Typically, subminiature circuit breakers presently in use have first and second line terminals mounted in the circuit breaker housing that extend through respective openings in a selected wall, such as a bottom wall, for secure attachment to a circuit path, as by threaded interconnection therewith as shown, for example, in U.S. Pat. No. 3,361,882, assigned to the assignee of the present invention, the subject matter of which is incorporated herein by this reference. When auxiliary circuits are provided, it is known to provide a socket having a metal member for electrical connection and another metal member formed with spring fingers for engaging a shouldered connector pin, such as military specification connector (M39029), to retain the connector pin in a socket. Such use involves a compromise between using a spring member having desired low force to reduce stress for optimum long life and the need for making the fingers relatively rigid to resist buckling of the fingers when extraction of the connector pin is attempted with the result that retentive capability of the socket is sacrificed.

SUMMARY OF THE INVENTION

It is an object of the present invention to provide a socket for a circuit breaker housing or the like for receiving a shouldered connector pin with optimum retentive capability yet with minimal or no spatial interference in the circuit breaker receiving cavity of the circuit breaker housing;

Another object of the invention is the provision of a socket for receiving a shouldered connector pin, such as a military specification connector pin M39029/1-101, with enhanced retentive capability as well as enhanced reliability of electrical connectivity;

Another object of the present invention is the provision of a socket for receiving a shouldered pin that is of lower cost and easier to assemble than prior art sockets.

Yet another object of the invention is to overcome the limitations of the prior art mentioned above.

Briefly, in accordance with a preferred embodiment of the invention, a selected wall of the circuit breaker housing is formed with an open, connector pin receiving channel in a face surface thereof. The channel extends, in accordance with the preferred embodiment, along a selected axis with first, second and third continuous axial lengths having respective first, second and third radii to form a generally semi-circular channel surface, as seen in a cross section taken perpendicular to the selected axis at each axial length. The pin receiving entrance is located at an outer end of the first axial length. The radius of the second axial length forms a stop surface or shoulder at the inner end of the first axial length and extends from a first depth of the channel surface of the first axial length to a second, greater depth of the channel surface of the second axial length. The radius of the third axial length is selected to be less than the first and second radii.

In accordance with preferred embodiments, an electrically conductive spring member is received over the channel with a set of two spring legs extending from the spring member toward the first axial length portion of the channel. Preferably, a second set of two spring legs also extends from the spring member toward the third axial length portion of the channel and can serve as redundant electrical contacts. Preferably, the spring member is attached to the selected wall of the circuit breaker housing and is provided with a circuit connection surface area.

A retainer plate of suitable material, such as the same material that the selected wall of the circuit breaker housing is composed of, is received over the spring member and fastened to the selected wall and provides support to the spring member.

Use of the shoulder formed between the first and second axial lengths of the pin receiving channel in the housing wall as a retaining member, abetted by the supportive retainer plate or housing wall, allows one to select the spring member on the basis of optimization of electrical connectivity with the connector pin due to the enhancement of the overall retention capability of the pin within the socket.

Other objects, features and advantages of the circuit housing and socket of the invention will appear from the following detailed description of preferred embodiments taken together with the accompanying drawings.

DETAILED DESCRIPTION OF PREFERRED EMBODIMENTS

Figure 1:
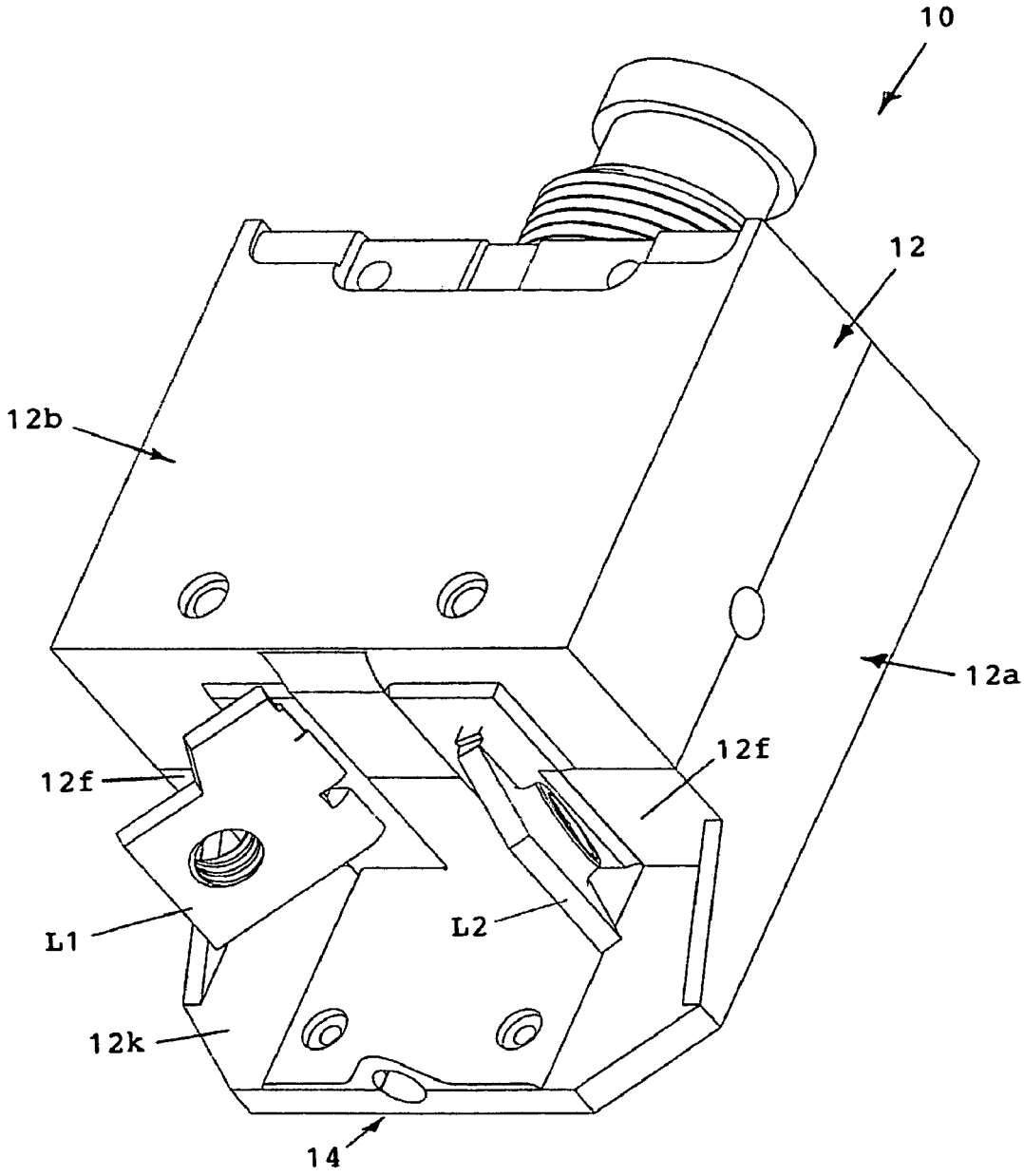
FIG. 1 is a perspective view of a subminiature circuit breaker having a supplemental pin receiving socket made in accordance with a preferred embodiment of the invention.
Figure 2:
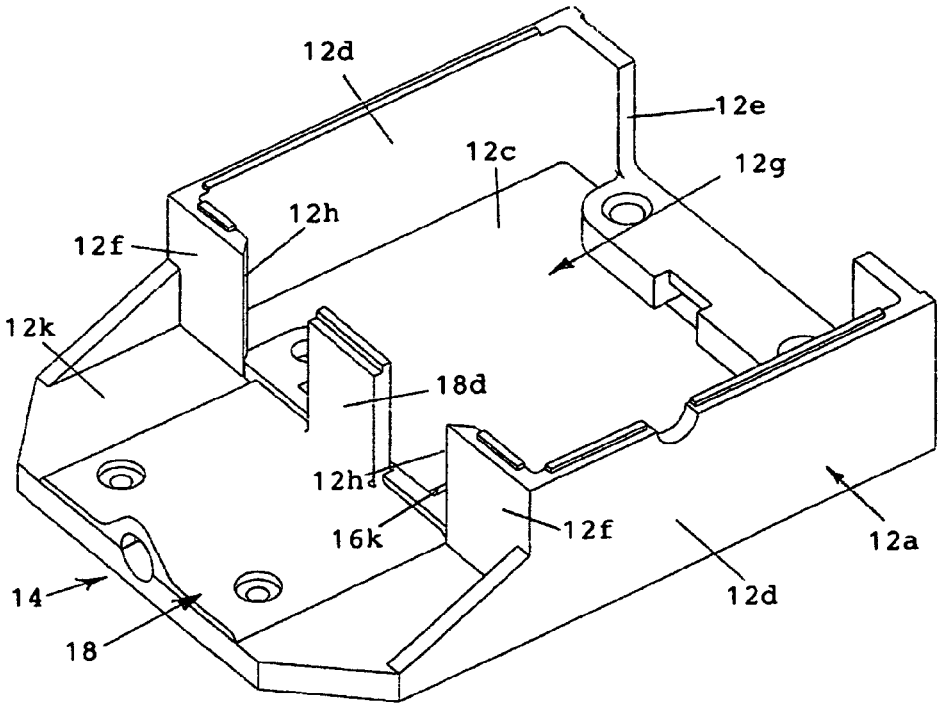
FIG. 2 is a perspective view of a housing half of the FIG. 1 circuit breaker showing details of the socket.
Figure 3A:
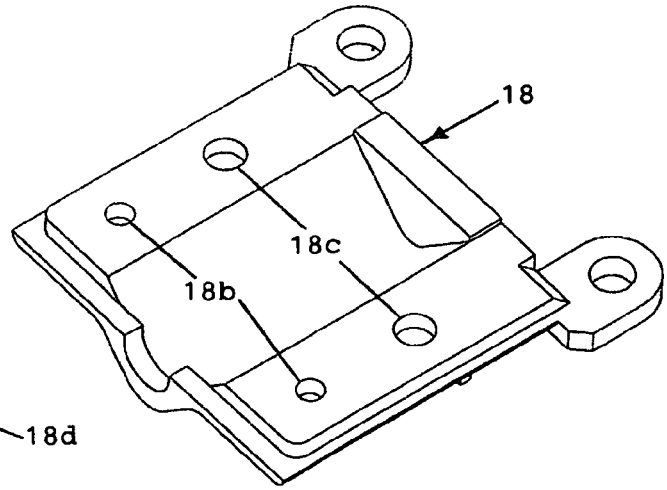
FIG. 3 is a perspective view of the top side of the retainer plate also shown in FIGS. 1 and 2 and FIG. 3(*a*) is a perspective view of bottom side of the retainer plate.
Figure 3:
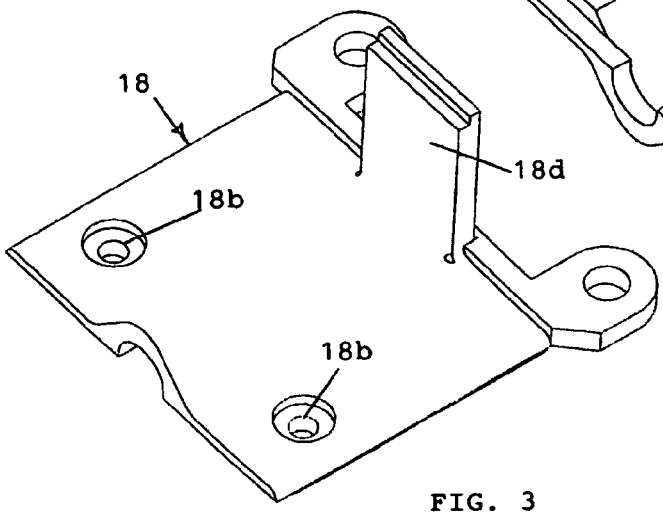
Figure 5A:
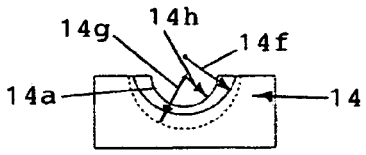
FIG. 5 is a view similar to FIG. 2 but shown without the FIG. 3 retainer plate or FIG. 4 spring member and FIG. 5(*a*) is an enlarged partial front view of the channel shown in FIG. 5 showing the semicircular channel surface of the several axial lengths.

With reference to FIGS. 1 and 2, a circuit breaker 10, made in accordance with a preferred embodiment of the invention, is shown comprising a housing 12 having first and second interfitting housing portions 12*a*, 12*b*, respectively. Housing portion 12*a* includes, with respect to the orientations shown in the drawings, a bottom wall 12*c*, two opposed side walls 12*d*, a pushbutton actuator receiving end wall 12*e* and opposed line terminals receiving end wall portions 12*f* forming part of the end wall, leaving an open cavity 12*g* for receipt of circuit breaker structure and accompanying circuitry, to be discussed. Cavity 12*g* is enclosed by housing portion 12*b* suitably fastened to side walls 12*d*, end wall 12*e* and wall portions 12*f*. First and second line terminals L1, L2 are mounted within cavity 12*c* and extend through openings 12*h* for suitable electrical attachment to a selected circuit path to be monitored.

Figure 5:
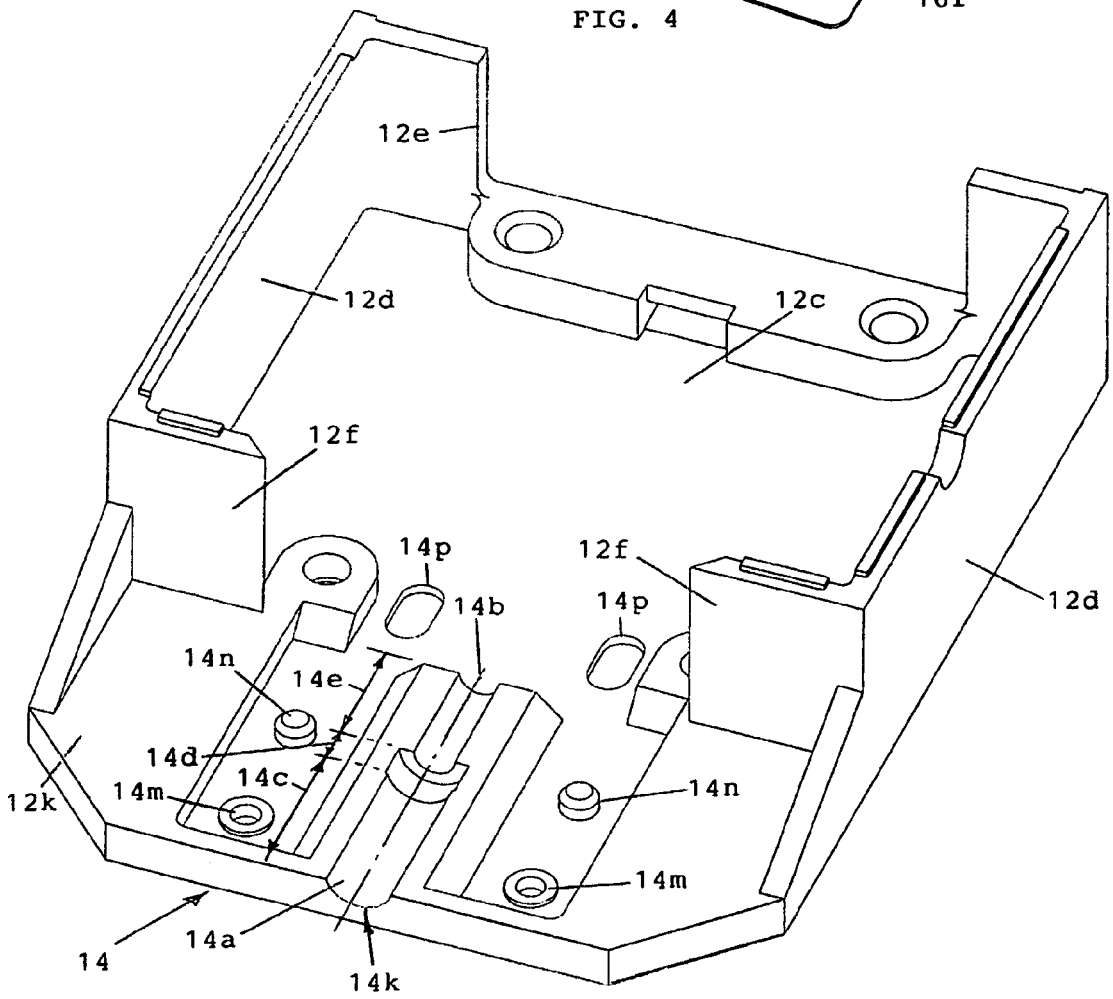

In a first preferred embodiment shown and described, a portion 12*k* of wall member 12*c*, made of dielectric material extends beyond cavity 12*c* to a length generally coextensive with line terminals L1, L2 and is used as a terminal barrier for preventing arcs and shorts external to the circuit breaker. With particular reference to FIGS. 5, 5(*a*), a pin receiving socket 14 is provided by forming an open pin receiving channel 14*a* in a face surface of wall portion 12*k*. Channel 14*a* extends along a selected axis 14*b* generally parallel to the face surface of the wall and comprises respective first, second and third continuous axial lengths 14*c*, 14*d* and 14*e*. Channel 14*a* has a channel surface that is generally semicircular with respect to a cross section taken perpendicular to axis 14*b* through each of the axial lengths with a first radius 14*f* for first axial length 14*c* selected to slidingly receive the shoulder of a selected shouldered pin, a second radius 14*g* for the second axial length 14*d*, larger than radius 14*f* and a third radius 14*h* for third axial length 14*e* smaller than radii 14*f* and 14*g*. The center of radius 14*f* is selected so that the shoulder 20*b* of a pin 20 (see FIG. 6) can slide along radius 14*f* while being inserted and then snap into concentricity with radius 14*g* while pin portion 20*a* comes to rest against radius 14*f*. Thus an accommodating shouldered connector pin can be slidingly inserted into the first axial length 14*c* of channel 14*a* from an outer end 14*k* along the first axial length until the flange of the connector pin forming the shoulder is aligned with second axial length 14*d* so that the flange can move from a position in engagement with the channel surface of first axial length 14*c* defined by radius 14*f* to a greater depth defined by radius 14*g* in the channel when it reaches second axial length 14*d*. This step between the first and second radii serves as a stop surface or shoulder, to be discussed further.

Figure 4:
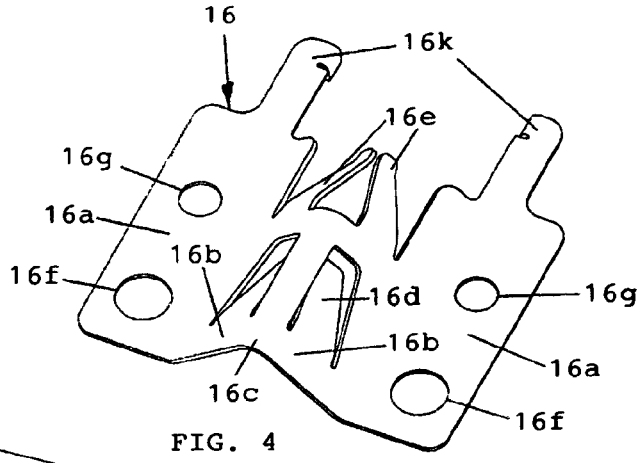
FIG. 4 is a perspective view of a spring member used in the FIGS. 1 and 2 structure.
Figure 6:
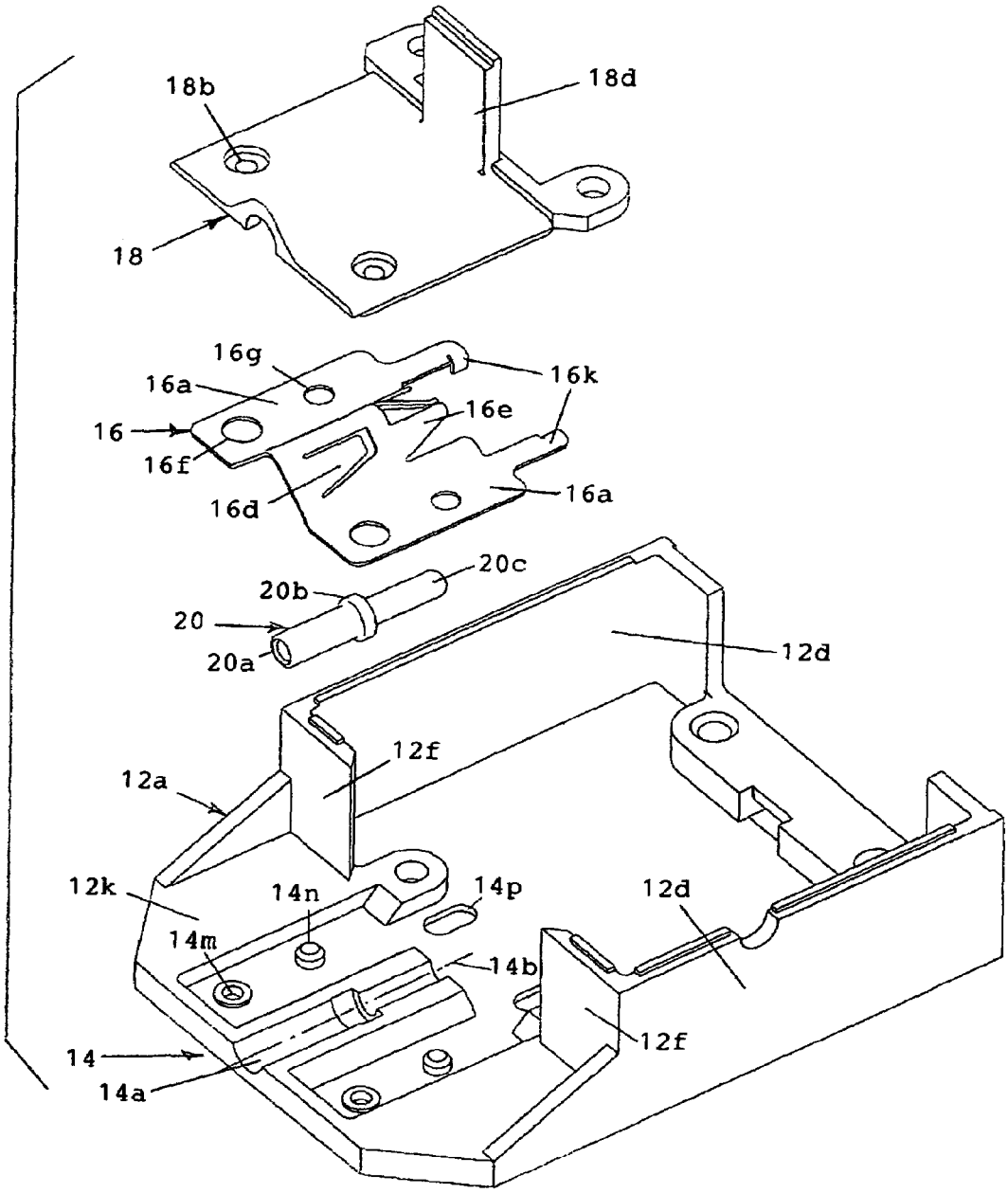
FIG. 6 is an exploded perspective view showing the FIG. 5 housing half, the FIG. 4 spring member, the FIG. 3 retainer plate and a typical shouldered connector pin 20 for receipt in the socket.
Figure 7A:
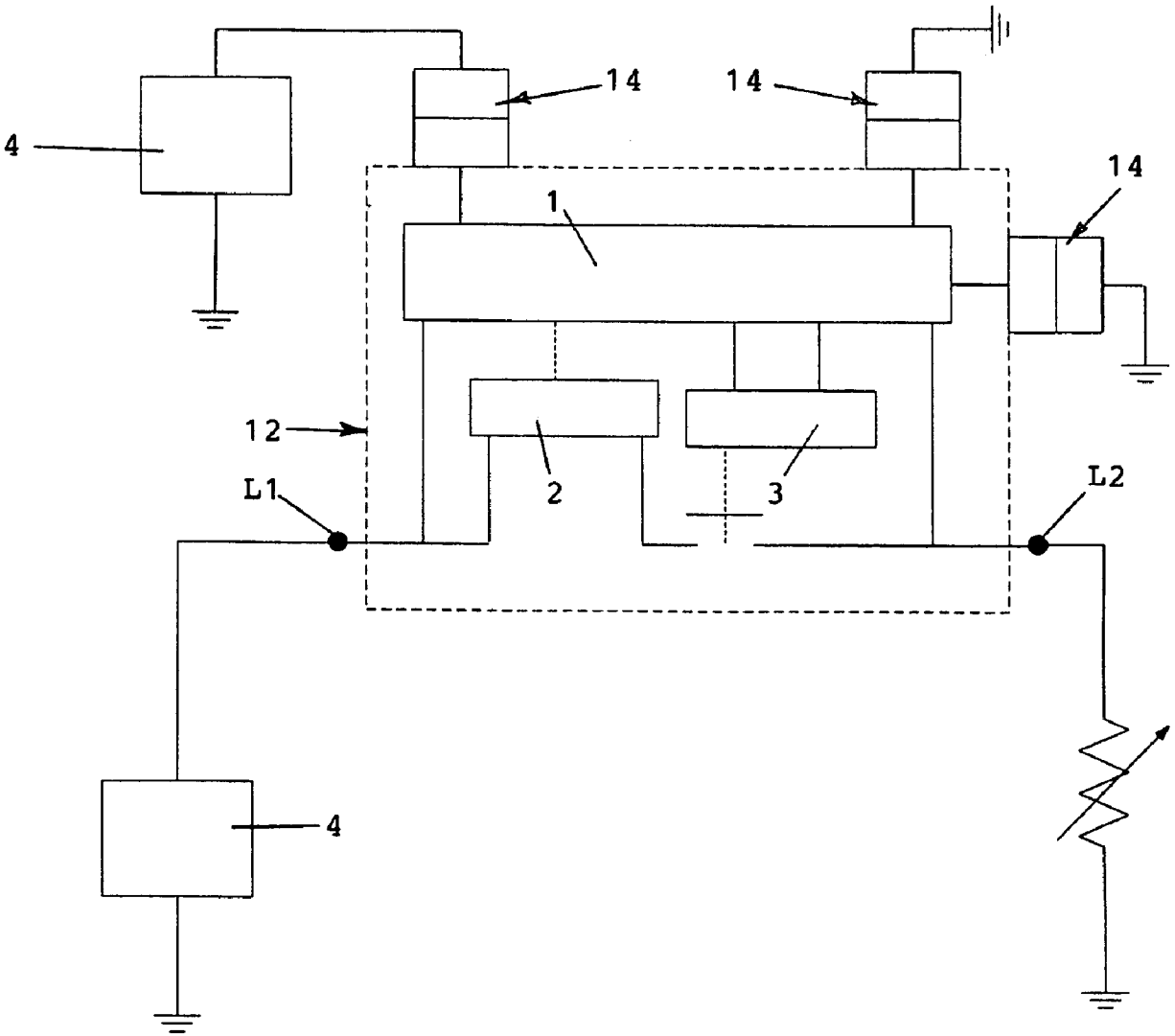
FIGS. 7(*a*)–7(*d*) show typical circuit breaker features and auxiliary circuits that can be mounted in the housing and with which the socket of the invention can be advantageously used.
Figure 7B:
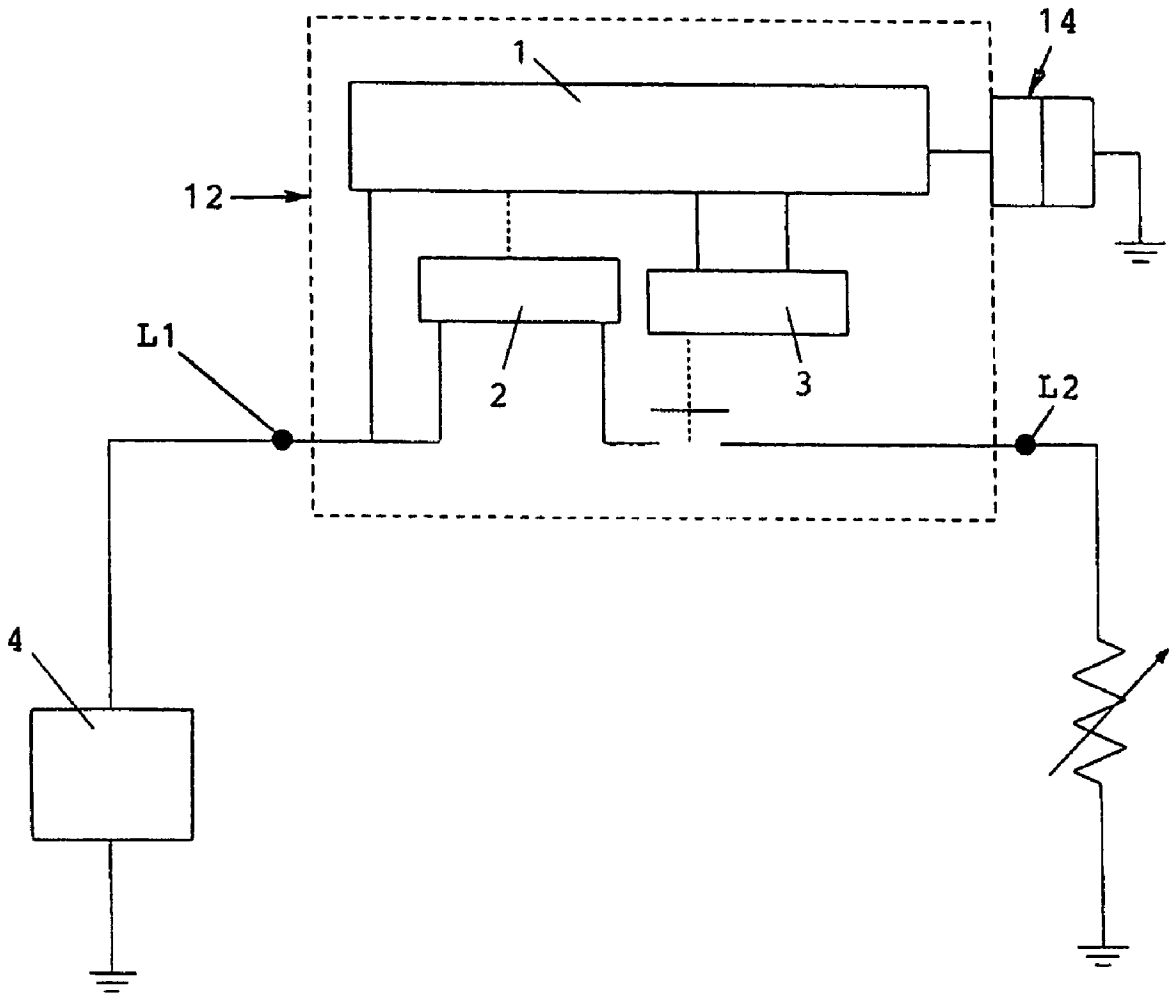
Figure 7C:
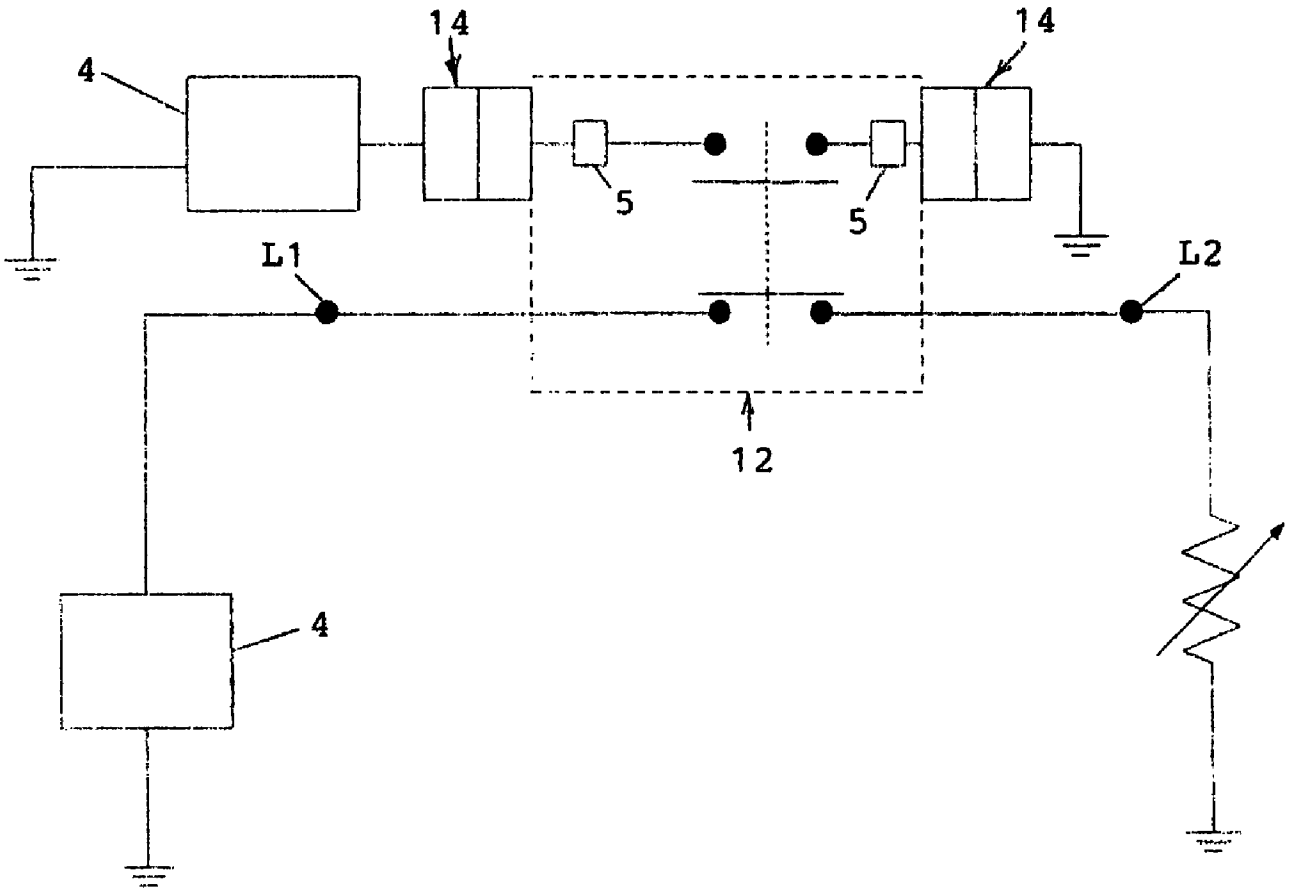
Figure 7D:
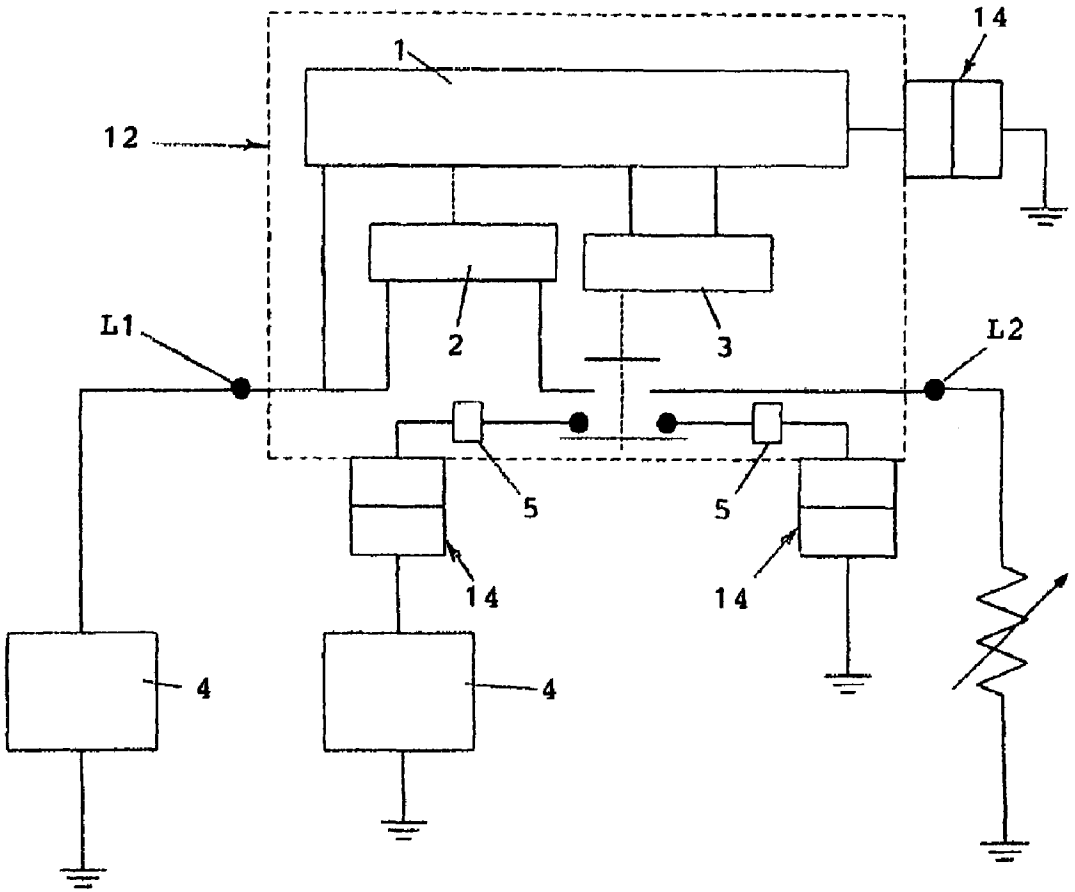

With reference to FIGS. 4 and 6, an electrically conductive spring member 16 is provided for placement over channel 14*a*. Spring member 16 has first and second generally flat plate portions 16*a* integrally joined to respective wall portions 16*b* that are inclined toward each other and integrally joined at a central portion 16*c*. A first set of at least one spring contact finger 16*d*, preferably two spring contact fingers 16*d*, one struck from each respective side wall as shown in the drawings, and extending downwardly, as seen in FIG. 4, is adapted to engage a connector pin disposed in the first axial length 14*c*. The distal free end portions of fingers 16*d* serve to urge a connector pin received in the channel against the channel surface as well as to make electrical contact therewith. Although the spring member can be provided with only a single set of contact fingers, it can also be formed with a second set of at least one spring contact finger 16*e*, preferably two spring contact fingers 16*e*, adapted to engage a connector pin received in the third axial length 14*e*. Contact fingers 16*e* serve as redundant contacts to provide enhanced reliability. Contact resistance can be minimized by placement of high electrical conductivity material at the distal fee end of either or both sets of contact fingers. Suitable attachment structure for the spring member is provided, such as attachment holes 16*f* in side portions 16*b* as well as guide holes 16*g* for attachment to the housing wall. An electrically conductive tab portion 16*k* extends longitudinally from each spring attachment plate portion 16*a* and is aligned with access holes 14*p* to provide a circuit connection tab for circuitry within the housing, to be discussed.

A retainer plate 18 is placed over the spring member to retain and provide support for the spring member. Retainer plate 18 has a recessed central portion 18*a* to accommodate spring member 16 and is provided with attachment holes 18*b* for alignment with holes 16*f* and holes 14*m* of wall portion 12*k* and blind guide holes 18*c* for receipt of guide pins 14*n* also received through spring member guide holes 16*g*. Retainer plate 18 is also provided with an upstanding wall portion 18*d* that is received between terminals L1,L2 completing the end wall of the housing along with portions 12*f*

As seen in FIG. 6, a shouldered connector pin 20 has a radially extending flange 20*b*, or shoulder, that can be accommodated in first and second axial lengths 14*c*, 14*d*. The shoulder is disposed intermediate to a wire lead connecting portion 20*a* and a cylindrical head portion 20*c*. The third axial length 14*e* is formed with radius 14*h* selected to accommodate head portion 20*c*.

FIGS. 7(*a*)–7(*d*) show several examples of circuitry and circuit breaker features that can be mounted in housing 12 with which the socket of the invention can be advantageously used without encroaching upon space used for the circuit breaker features and associated circuitry. Socket 14, having improved retentive capability as well as optimized electrical connectivity can be used as a ground or power connection for a logic and/or sense circuit or the like in a device having such circuits in addition to a circuit breaker function.

For example, FIG. 7(*a*) relates to a mechanical circuit breaker, such as the breaker shown in U.S. Pat. No. 3,361,882 mentioned supra, with which socket 14 is used for auxiliary circuit connections and includes a housing 12 in which is disposed a logic circuit 1, sense mechanism 2 and an actuation mechanism 3 including suitable circuit breaker contacts and using one socket 14 to interconnect logic circuit with ground and another to interconnect logic with a power source 4. Sense mechanism 2 is connected to terminal L1 in a conventional manner while actuation mechanism 3 is connected to terminal L2

FIG. 7(*b*) relates to an arc fault device in which socket 14 is used for providing a circuit ground. Power source 4 is connected to terminal L1 which in turn is connected to logic 1 and sense mechanism 2. Actuation mechanism 3 is connected to logic 1 and, through circuit breaker contacts, to terminal L2. Socket 14, connected to logic circuit 1, provides a ground connection.

FIGS. 7(*c*) relates to an arc fault circuit breaker having mechanical auxiliary circuit function and with sockets 14 providing a circuit ground as well as auxiliary circuit connections including conditioning circuit 5

FIG. 7(*d*) relates to an arc fault device with mechanical auxiliary circuit function in which sockets 14 provide a circuit ground as well as auxiliary circuit connections. It will be realized that the above arrangements are to be considered as exemplary in utilizing socket 14 made in accordance with the invention and not in a limiting sense.

Figure 10:
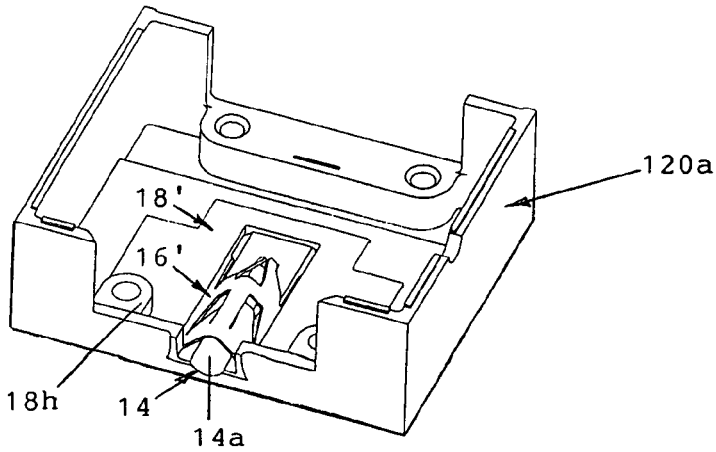
FIG. 10 is a perspective view, similar to FIG. 9 but of a smaller scale and shown with the socket structure made in accordance with the second embodiment
Figure 11:
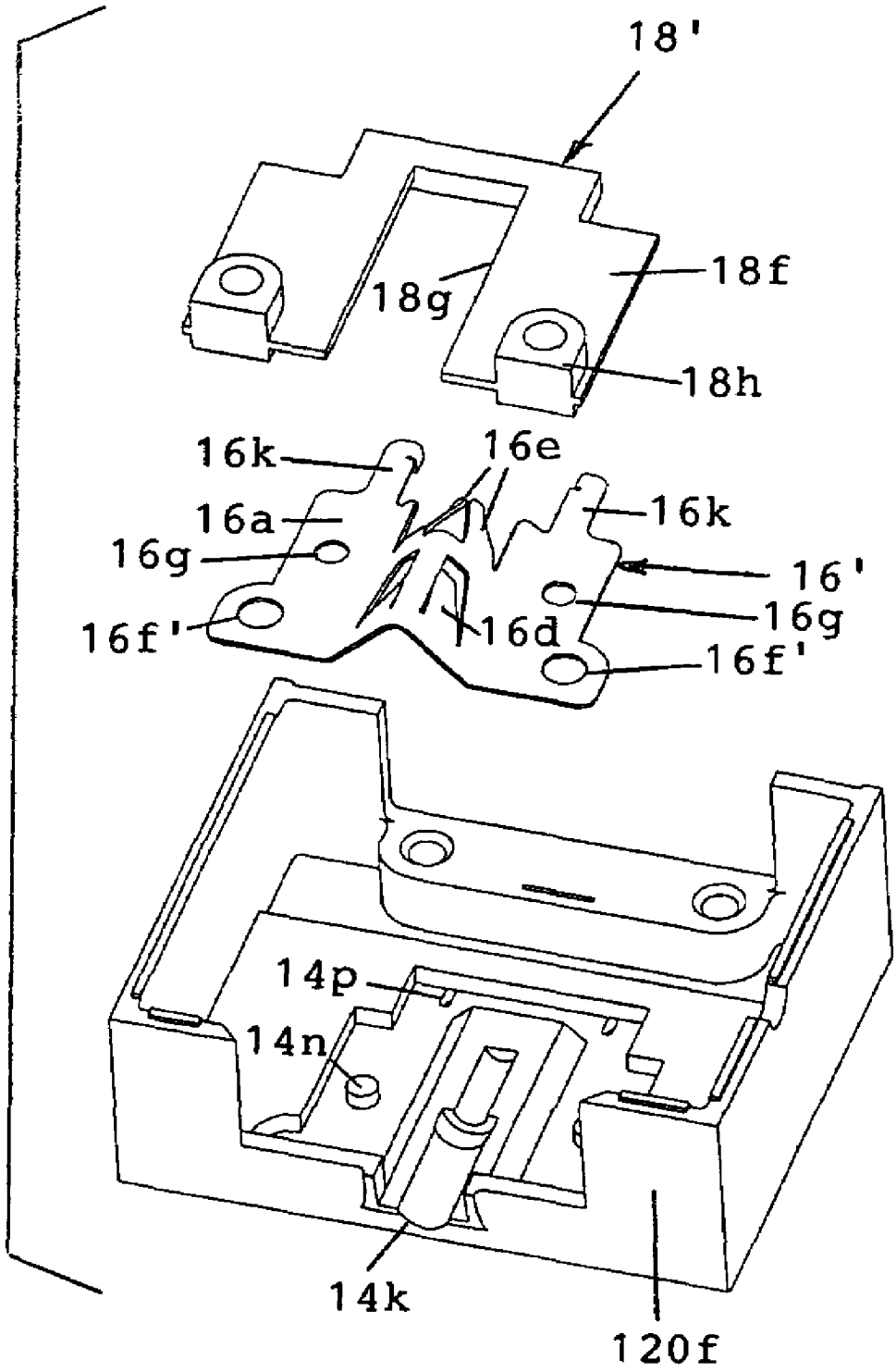
FIG. 11 is an exploded perspective view of the FIG. 10 structure.
Figure 12:
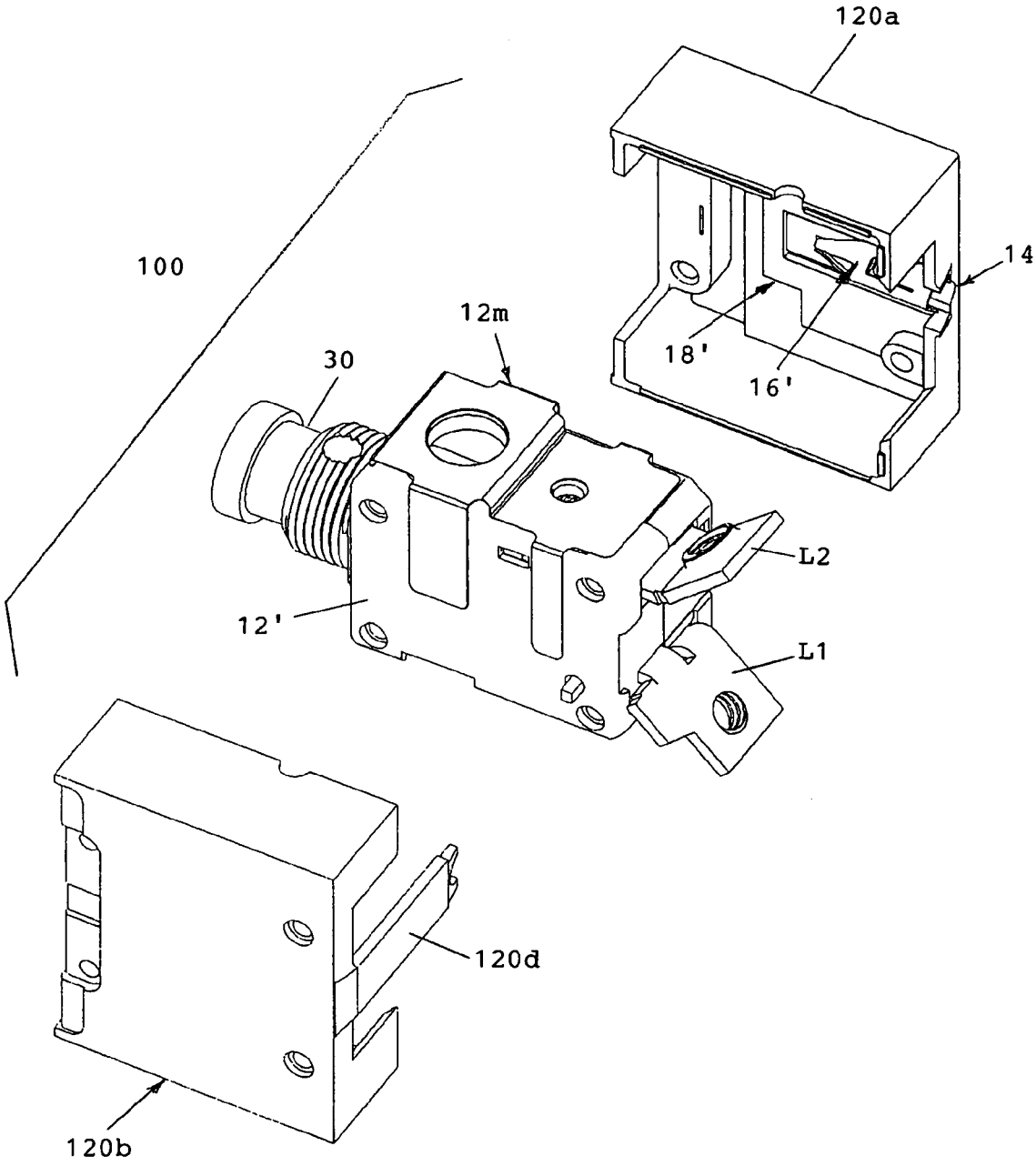
FIG. 12 is an exploded view of FIG. 8 showing the circuit breaker 100 along with a two part housing shell that receives the circuit breaker and forms part of the housing thereof.

A second preferred embodiment is shown in FIGS. 8 through 12. With particular reference to FIG. 12, housing 120 of circuit breaker 100 comprises first and second housing halves 120*a*, 120*b*, respectively, adapted to receive therebetween circuit breaker 12'. Circuit breaker 12' is essentially the same as the circuit breaker of the first embodiment but without a terminal barrier 12*k* and shown with insulation tape 12*m*. The circuit breaker includes a conventional push button and latching assembly 30 along with circuit breaker contacts adapted to close and open a circuit path. These assemblies are conventional and will not be described in detail however for further information for similar structure reference can be had to U.S. Pat. No. 3,361,882, noted above.

Figure 9:
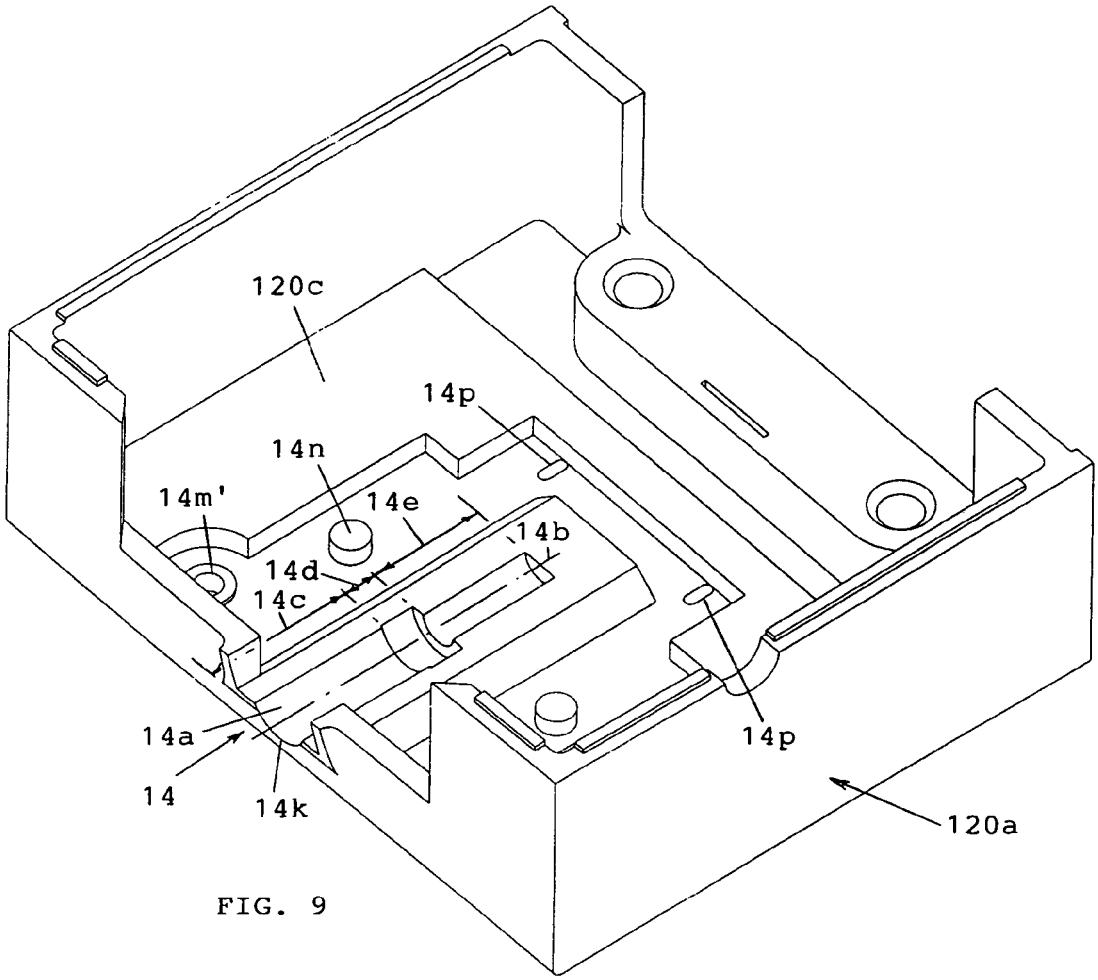
FIG. 9 is a perspective view of one of the housing halves of the FIG. 8 circuit breaker showing a connector pin receiving channel formed in the face surface of a wall of the housing half.

Pin connector socket 14 is formed in housing half 120*a*, best seen in FIGS. 9–11. As seen in FIG. 9, the open pin receiving channel 14*a* is formed in a face surface of wall 120*c* in housing half 120*a* of circuit breaker 100 and includes three axial length, 14*c*, 14*d* and 14*e*, as in the first embodiment, and having like radii for receipt of a conventional connector pin 20.

Figure 8:
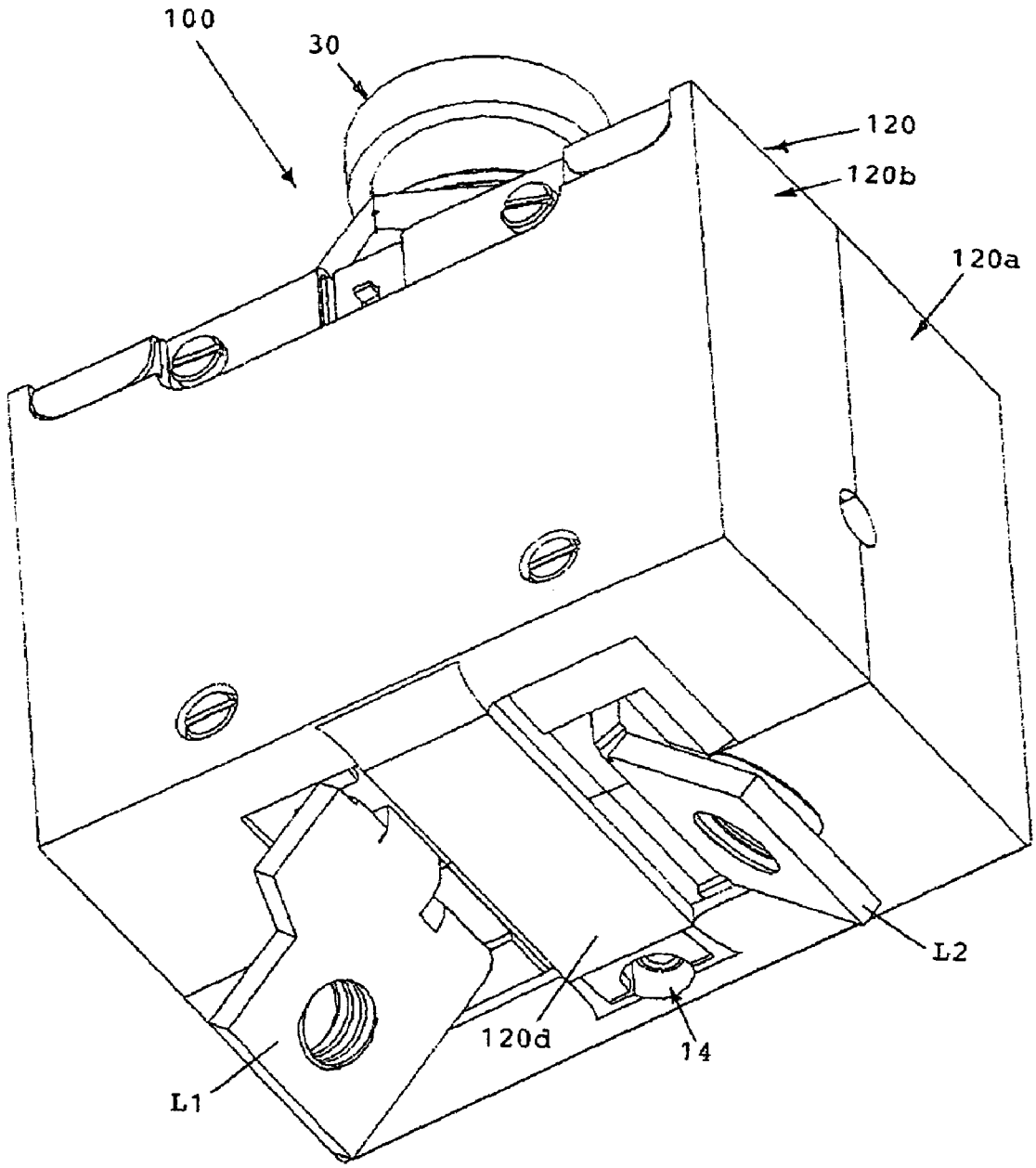
FIG. 8 is a perspective view, similar to FIG. 1, of a circuit breaker made in accordance with a second preferred embodiment.

As seen in FIGS. 10 and 11, retainer plate 18' has side portions 18*f* for receipt on attachment plate portions 16*a* of spring member 16', as in the first embodiment, however, it also is formed with a cut-out central portion 18*g* to accommodate the central portion of spring member in which contact fingers 16*d* and optional fingers 16*e* are formed. Another variation is that wall portion 120*d*, seen in FIGS. 8 and 12, is attached to housing half 120*b* whereas in the first embodiment the comparable wall portion 18*d* is attached to retainer plate 18. Guide holes 16*g* are provided for receiving guide pins 14*n* which are also received in blind holes in the bottom surface of retainer plate 18' (not shown), as in the first embodiment. Attachment holes 16*f'* are formed in attachment plate portions 16*a* set slightly further apart than in the spring member of the first embodiment, for alignment with attachment holes in bosses 18*h* of the retainer plate.

Although retainer plate is formed with a cut-out portion 18*e*, if further support is needed for the central portion of spring member 16', the side wall of housing 12' is disposed closely adjacent thereto and will serve that purpose. For other details of socket 14 not specifically discussed in relation to the second embodiment, reference may be had above to the first embodiment.

Thus in accordance with the invention, a socket having improved reliability and fewer parts compared to prior art sockets discussed above is provided, a socket having a single metal member that provides both electrical connectivity as well as retention of a shouldered pin.

It should be understood that although particular embodiments of the invention have been described by way of illustrating the invention, other embodiments and variations are possible. It is intended that the invention include all modifications and equivalents of the disclosed embodiments that fall within the scope of the claims.

What is claimed:

1. An electrical socket for a housing mounting a circuit comprising a first wall member of the housing having a face surface formed with an open connector pin receiving channel in the face surface extending along a selected axis, the channel defined by a channel surface having a first axial length of a selected first depth extending from an outer end to an inner end along the selected axis, a shoulder formed by a surface at the inner end extending from the channel surface at the first depth toward a second depth at the inner end, an electrically conductive spring member disposed over the channel, the spring member extending over the first axial length aligned with the channel to electrically engage a connector pin inserted into the pin receiving channel and urge the connector pin against the channel surface, whereby a connector pin having a size to be accommodated in the channel and having a shoulder formed by a radially extending flange that is inserted into the outer end of the channel will be biased by the spring member against the channel surface of the first axial length and upon further insertion when the flange moves beyond the inner end of the first axial length and being biased by the spring member, a portion of the flange will move between the first and second depths with the flange engaging the shoulder at the inner end serving as a stop surface inhibiting extraction of the connector pin.

2. An electrical socket according to claim 1 further comprising a fixed retainer member mounted in the circuit breaker housing extending over the spring member and channel to provide support for the spring member.

3. An electrical socket according to claim 1 in which the channel is formed with second and third axial lengths continuous with the first axial length, and the conductive spring member extends over the third axial length and is provided with a redundant electrical contact adapted to engage a connector pin received in the third axial length of the channel.

4. An electrical socket according to claim 2 in which the fixed retainer member is a plate attached to the first wall member.

5. An electrical socket according to claim 2 in which the fixed retainer member is a housing wall member spaced from and extending generally parallel to the first wall member.

6. An electrical socket for a housing mounting a circuit comprising a first wall member of the housing having a face surface formed with an open connector pin receiving channel in the face surface extending along a selected axis, the channel defined by a channel surface having a first axial length of a selected first depth extending from an outer end to an inner end along the selected axis, a shoulder formed by a surface at the inner end extending from the channel surface at the first depth toward a second depth at the inner end, an electrically conductive spring member disposed over the channel, the spring member having a set of at least one spring finger extending over the first axial length aligned with the channel to electrically engage a connector pin inserted into the pin receiving channel and urge the pin against the channel surface, and a retainer plate attached to the first wall member to retain the spring member with a portion of the spring member being exposed within the housing to serve as an electrical connection tab for a circuit disposed in the housing whereby a connector pin having a size to be accommodated in the channel and having a shoulder formed by a radially extending flange that is inserted into the outer end of the channel will be biased by the spring finger against the channel surface of the first axial length and upon further insertion when the flange moves beyond the inner end of the first axial length and being biased by the spring finger, a portion of the flange will move to a position between the first and second depths with the flange engaging the shoulder at the inner end serving as a stop surface inhibiting extraction of the connector pin.

7. An electrical socket according to claim 6 in which the set of at least one spring finger comprises a pair of side-by-side spring fingers.

8. An electrical socket according to claim 6 in which a second axial length of the channel is formed contiguous with the inner end of the first axial length and which has a channel surface with the second depth and a further third axial length of the channel is formed in series with the first and second axial lengths and is contiguous with the second axial length, the third axial length having a channel surface having a third depth less than the second depth.

9. An electrical socket according to claim 6 in which the housing forms an arc fault circuit breaker and the circuit includes a logic circuit, a sensor portion and an actuator portion and the pin connector provides a ground connection for the logic circuit.

10. An electrical socket according to claim 6 in which the channel surface of the first axial length has a generally semi-circular configuration having a first radius seen in a cross section taken normal to the selected axis.

11. An electrical socket according to claim 6 in which the first wall member is part of a case half of the housing and the retainer plate generally lies in a plane and has a side wall portion extending from the retainer plate generally perpendicular to the plane, the side wall portion adapted to fit between first and second terminals extending through the housing.

12. An electrical socket according to claim 8 in which the spring member has a second set of at least one spring finger axially spaced from the first set and aligned with the third axial length of the channel serving to bias the connector pin against the channel surface and as a redundant electrical contact with the connector pin.

13. An electrical socket according to claim 12 in which the second set of at least one spring finger comprises a pair of side-by-side spring fingers.

14. An electrical socket according to claim 8 in which the channel surface of the first axial length has a generally semi-circular configuration along the first axial length having a first radius seen in a cross section taken normal to the selected axis.

15. An electrical socket according to claim 14 in which the channel surface of the respective second and third axial lengths each has a generally semi-circular configuration as seen in a cross section taken normal to the selected axis, the second axial length having a second radius greater than the first radius and the third axial length having a third radius less than the second radius.

16. An electrical socket according to claim 15 in which the spring member comprises a pair of spaced apart generally flat plate portions for attachment to the first wall member, each integrally joined to respective first and second wall portions, the wall portions being inclined toward each other and integrally joined together at a central portion, the set of at least one spring leg comprising a spring leg being struck from each inclined wall portion.

17. An electrical socket according to claim 16 further comprising a second set of at least one spring leg axially spaced from the first set and comprising a spring leg being struck from each inclined wall portion and aligned with the third axial length.

18. An electrical socket for a housing mounting a circuit comprising:

a wall having a face surface, an open channel having a channel surface formed in the face surface, the open channel having a first axial length extending between a first outer end and a second inner end and having a first depth from the face surface, the open channel being formed to accommodate a radially extending flange of a shouldered electrical connector pin, a stop surface formed at the inner end of the first axial length and extending from the channel surface to a second depth greater than the first depth whereby a portion of the radially extending flange of an accommodating shouldered connector pin can move from a position in engagement with the channel surface of the first axial length at the first depth when disposed in the first axial length to a second position at a depth greater than the first depth when the flange of the connector pin is inserted beyond the first axial length, an electrically conductive spring member received over the open channel, the spring member extending toward the open channel and adapted to place a spring bias on a connector pin received in the first axial length of the channel urging the connector pin against the channel surface, a portion of the spring member exposed within the housing to serve as an electrical connection point, whereby extraction of a selected accommodating shouldered connector pin having a radially extending flange inserted into the channel with the flange of the pin disposed in the second position will be inhibited by engagement of the flange with the stop surface.

* * * * *